US006176712B1

(12) United States Patent
Huang

(10) Patent No.: US 6,176,712 B1
(45) Date of Patent: Jan. 23, 2001

(54) SAFE CONNECTOR

(75) Inventor: Chin-Chu Huang, Taoyuan (TW)

(73) Assignee: Delta Electronics Inc., Taoyuan Shien (TW)

( * ) Notice: Under 35 U.S.C. 154(b), the term of this patent shall be extended for 0 days.

(21) Appl. No.: 09/414,978

(22) Filed: Oct. 7, 1999

(30) Foreign Application Priority Data

Nov. 16, 1998 (TW) ..... 87218952

(51) Int. Cl.[7] ..... H01R 13/44
(52) U.S. Cl. ..... 439/140
(58) Field of Search ..... 439/135, 140, 439/141, 137

(56) References Cited

U.S. PATENT DOCUMENTS 5,466,164 * 11/1995 Miyazaki et al. ..... 439/140
5,599,196 * 2/1997 Powell et al. ..... 439/141
5,980,277 * 11/1999 Ichimura ..... 439/141

* cited by examiner

*Primary Examiner*—Paula Bradley
*Assistant Examiner*—Edwin A. León
(74) *Attorney, Agent, or Firm*—Bever, Hoffman & Harms, LLP; Patrick T. Bever

(57) ABSTRACT

Disclosed is a safe connector including a casing, a plurality of conducting elements, a protecting board, an elastic device, and a locking device. The casing has an opening. The plurality of conducting elements are set in the casing for conducting electricity. The protecting board is set in the casing for protecting the conducting elements from being touched. There are a plurality of holes set on the protecting board, and each of them corresponds to one of the conducting elements for passing the conducting elements therethrough. The elastic device is set between the casing and the protecting board for urging the protecting board against the opening, and a locking device is set in the casing for locking the protecting board in the casing.

24 Claims, 3 Drawing Sheets

SAFE CONNECTOR

FIELD OF THE INVENTION

The present invention relates to a safe connector.

BACKGROUND OF THE INVENTION

A battery backup unit (BBU) or a power supply in a computer is used for supplying an electric power, especially a DC power, for a power-consuming device. The voltage of the DC power can be very high. However, the conventional electric connector of the BBU or power supply is not safe enough because the conducting elements of the electric connector are usually exposed outside without any safety consideration. If a wet-handed child unwarily touches the conducting elements of the connector, this child will get an electric shock and probably get hurts.

Therefore, it is attempted by the applicant to provide a circuit adapted to be used in an electric connector so that the connector can safely supply an electric power.

SUMMARY OF THE INVENTION

It is therefore an object of the present invention to provide a novel safe connector such that the aforementioned limitations and difficulties encountered in the prior art can be overcome.

It is therefore another object of the present invention to provide a novel safe connector which can prevent someone from unwarily touching the conducting elements.

The safe connector of the present invention includes a casing having an opening, a plurality of conducting elements set in the casing for conducting electricity, a protecting board set in the casing for protecting the conducting elements from being touched, and having a plurality of holes set thereon, each of which corresponds to one of the conducting elements for passing therethrough the conducting elements, an elastic device set between the casing and the protecting board for urging the protecting board against the opening, and a locking device set in the casing for locking the protecting board in the casing.

When a corresponding connector is plugged into the safe connector through the opening, the locking device is pushed aside to push the protecting board into the casing so that the elastic device is compressed to pass the plurality of conducting elements through the holes of the protecting board for electrically connecting the both connectors. After the corresponding connector is pulled out of the safe connector, the protecting board is pushed back by the elastic device.

According to the present invention, the casing and the protecting board are made of an insulating material for protecting a user from the electric shock.

According to the present invention, the elastic device includes a plurality of elastic bodies, preferably springs. The conducting elements penetrate through the springs and there is a space between the conducting elements and the springs to prevent from the occurrence of short circuit.

According to the present invention, the locking device includes a plurality of locking pieces set around the protecting board. The locking pieces are preferably made of steel. Each of the locking pieces includes a V-shape guard for locking the protecting board underneath and preventing the protecting board from being pushed out of the opening, and includes a holder for holding the protecting board thereon.

Preferably, a specific one of the conducting elements is used for detecting whether a corresponding connector is connected with the safe connector. Only when the specific conducting element detects that the corresponding connector is connected with the safe conductor, the safe connector conducts electricity.

Preferably, the conducting elements are pins.

The present invention may best be understood through the following description with reference to the accompanying drawings, in which:

DETAILED DESCRIPTION OF THE PREFERRED EMBODIMENTS

Figure 1:
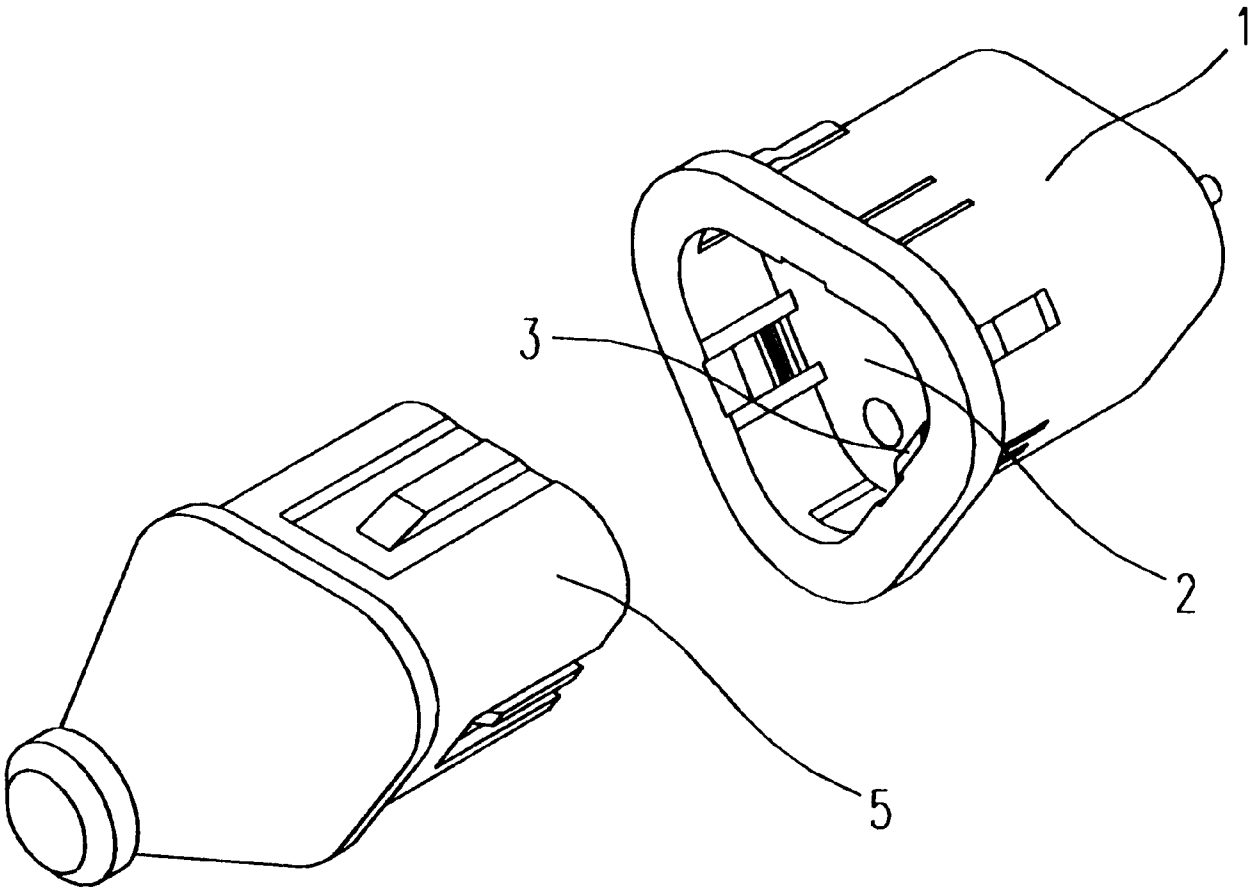
FIG. 1 is a perspective a diagram showing the outside of the safe connector according to the present invention.
Figure 2:
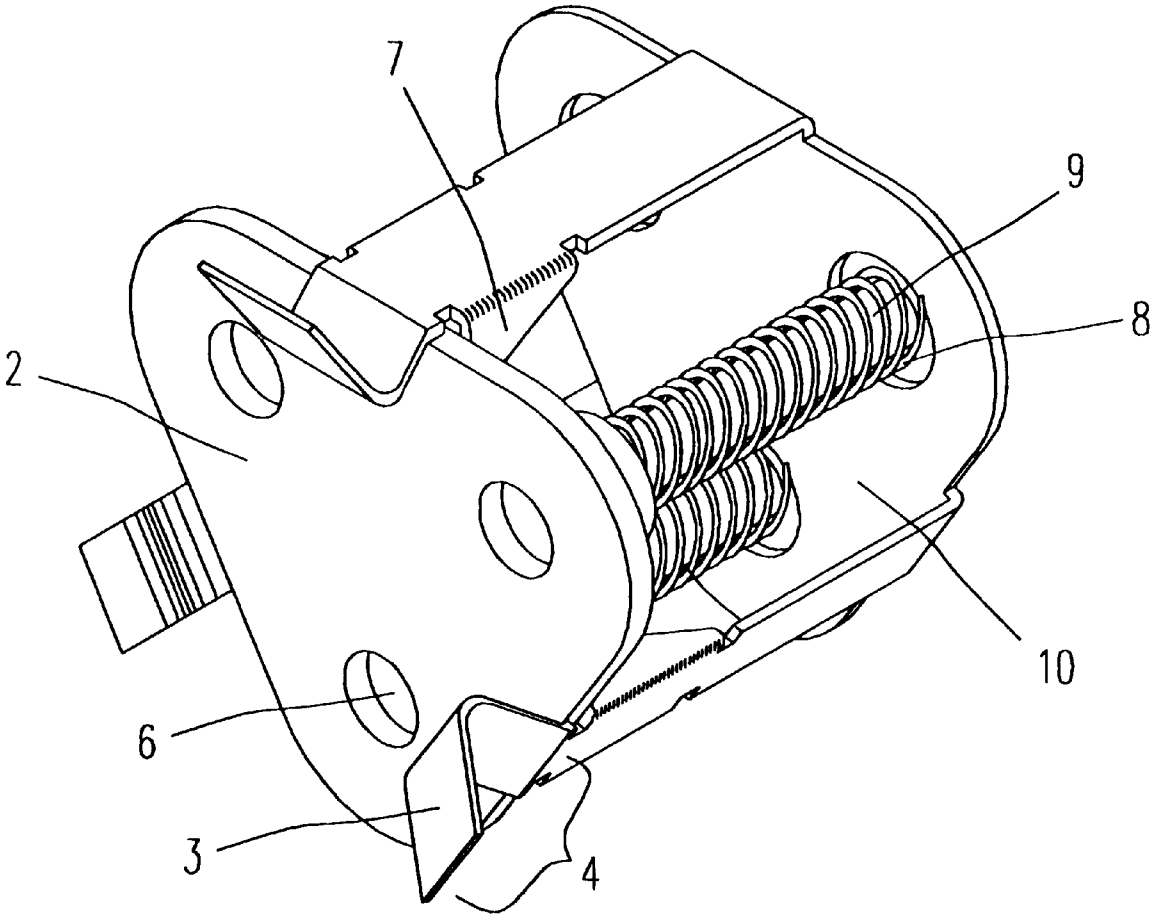
FIG. 2 is a perspective diagram showing the inside of the safe connector according to the present invention.

Please refer to FIG. 1 and FIG. 2. The safe connector of the present invention includes a casing 1, a protecting board 2, an elastic device 8, a plurality of conducting elements 9, and a locking device 10.

The casing 1 of the present invention has an opening for pushing a corresponding connector 5 into the safe connector. The plurality of connecting elements 9 are set in the casing 1 for conducting electricity. The protecting board 2 is used for protecting the connecting elements 9 from being touched. There are many holes 6 on the protecting board 2, and each of them corresponds to one of the connecting elements 9.

The elastic device 8 of the present invention is set between the casing 1 and the protecting board 2, and is used for urging the protecting board against the opening. The elastic device 8 includes a plurality of elastic bodies, preferably springs. As shown in FIG. 2, the conducting elements 9 usually pass through the springs 8 and there is a space between the conducting elements 9 and the springs 8 to prevent the occurrence of short circuit.

The locking device 10 of the present invention includes a plurality of locking pieces 3 set around the protecting board. The locking pieces 3 are usually made of steel so as to have some flexibility to be bent a little. As shown in FIG. 2, each of the locking pieces 3 includes a V-shape guard 4 for locking the protecting board 2 underneath and preventing the protecting board 2 from being pushed out of the opening of the casing 1 by the springs 8. Each of the locking pieces 3 further includes a holder 7 for holding the protecting board 2 thereon.

The detailed using method of the safe connector of the present invention is discussed as follows. When the corresponding connector 5 is plugged into the safe connector through the opening, the V-shape guard 4 and holder 7 of the locking device 10 are pushed aside. Thereafter, the protecting board 2 is pushed into the casing 1 so that the elastic device 8 is compressed to pass the plurality of conducting elements through the holes 6 of the protecting board 2. Therefore, the safe connector of the present invention is electrically connected to the corresponding connector 5, and an electric current can be transmitted from the safe connector of the present invention to the corresponding connector 5 through the conducting elements 9.

After the corresponding connector 5 is pulled out of the safe connector, the locking pieces 3 of the locking device 10 are bent back and the protecting board 2 is pushed back by the elastic device 8. Therefore, the protecting board is locked between the V-shape guard 4 and the holder 7 of the locking pieces 3 to prevent the protecting board 2 from being pushed out of the opening.

Figure 3:
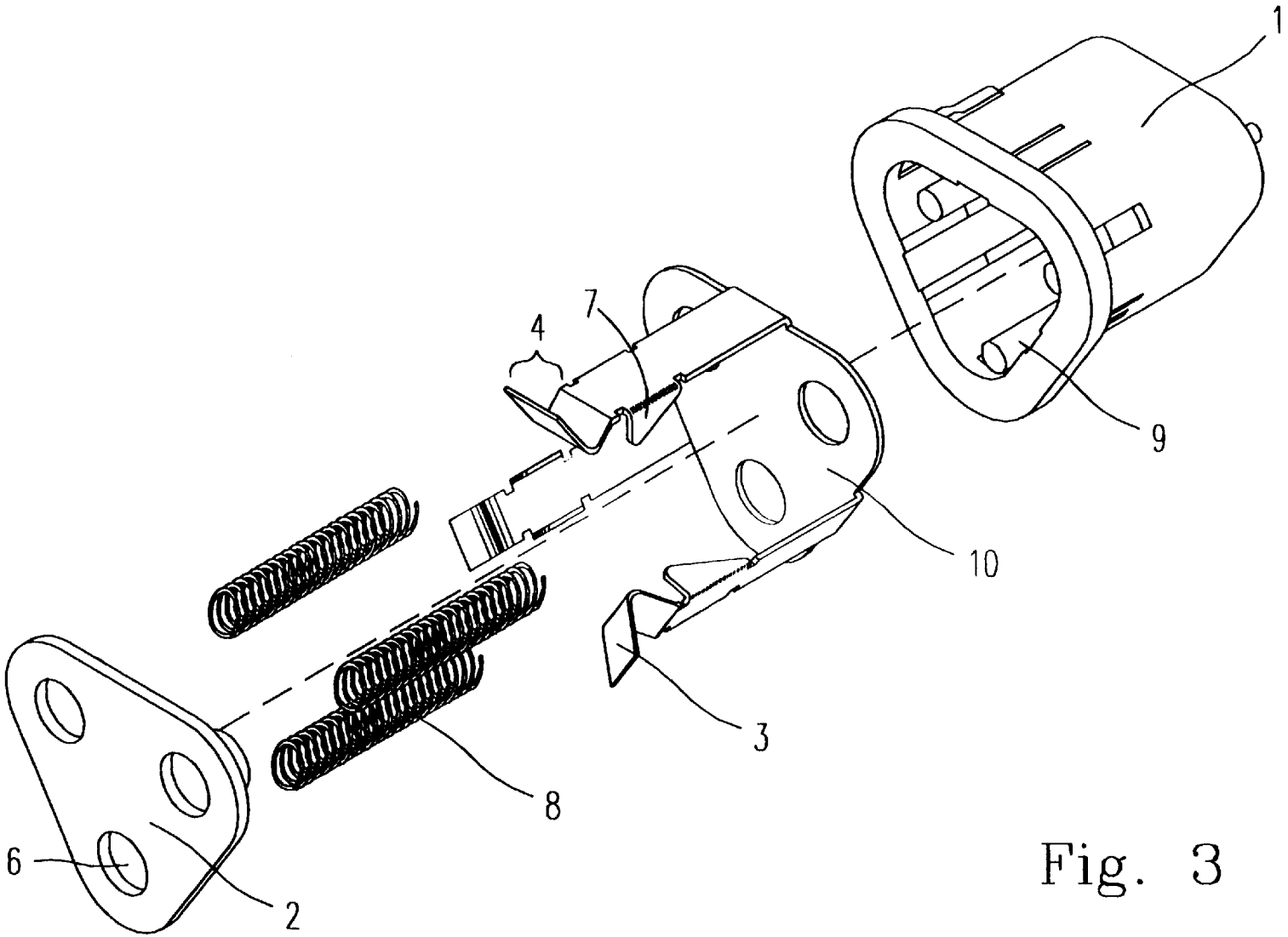
FIG. 3 is an exploded diagram showing the safe connector of the present invention.

FIG. 3 is an exploded diagram showing the safe connector of the present invention. From FIG. 3, we can understand that the safe connector of the present invention can be practiced by one skilled in the art.

Moreover, because the conducting elements are blocked by the protecting board, children can not touch the conducting elements. Only when all of the locking pieces are pushed aside, the protecting board can be pushed inward. Therefore, it is very safe for children.

Further, for more security, one of the conducting elements 9 of the present invention can be connected to a sensor for detecting whether a corresponding connector is connected with the safe connecter and an electric switch for switching on/off the electric power. Therefore, only when the corresponding connector is connected to the safe connector, the electric switch is switched on to let the safe connector of the present invention conduct electricity.

The outside of the safe connector shown in FIG. 1 is only a preferred embodiment, and the shape of the safe connector of the present invention may not be limited to this. The safe connector of the present invention is preferably used for transmitting a high-voltage (over 50V) DC current.

While the invention has been described in terms of what are presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A safe connector comprising:

a casing having an opening;

a plurality of conducting elements set in said casing for conducting electricity;

a protecting board set in said casing for protecting said conducting elements from being touched, and having a plurality of holes set thereon, each of which corresponds to one of said conducting elements for passing therethrough said conducting elements;

an elastic device set between said casing and said protecting board for urging said protecting board against said opening; and a locking device set in said casing for locking said protecting board in said casing such that said locking device prevents movement of said protecting board into said casing, thereby preventing exposure of said plurality of conducting elements, unless said locking device is pushed aside from said protecting board.

2. The safe connector according to claim 1, wherein said casing is made of an insulating material for protecting a user from the electric shock.

3. The safe connector according to claim 1, wherein said protecting board is made of an insulating material for protecting a user from the electric shock.

4. The safe connector according to claim 1, wherein said conducting elements are pins.

5. The safe connector according to claim 1, wherein said locking device is pushed aside from said protecting board when a corresponding connector is plugged into said safe connector through said opening such that said locking device is pushed aside by said corresponding connector, which then pushes said protecting board into said casing so that said elastic device is compressed to pass said plurality of conducting elements through said holes of said protecting board for electrically connecting said corresponding connector and said safe connector.

6. The safe connector according to claim 5, wherein after said corresponding connector is pulled out of said safe connector, said protecting board is pushed back by said elastic device.

7. The safe connector according to claim 1, wherein said elastic device includes a plurality of elastic bodies provided between said protecting board and said casing.

8. The safe connector according to claim 7, wherein said elastic bodies are springs.

9. The safe connector according to claim 8, wherein said conducting elements penetrate through said springs and there is a space between said conducting elements and said springs to prevent from the occurrence of short circuit.

10. The safe connector according to claim 1, wherein said locking device includes a plurality of locking pieces set around said protecting board.

11. The safe connector according to claim 10, wherein said locking pieces are made of steel.

12. The safe connector according to claim 11, wherein each of said locking pieces includes a V-shape guard for locking said protecting board underneath and preventing said protecting board from being pushed out of said opening.

13. The safe connector according to claim 12, wherein each of said locking pieces further includes a holder for holding said protecting board thereon.

14. The safe conducting element according to claim 1, wherein a specific one of said conducting elements is used for detecting whether a corresponding connector is connected with said safe connector.

15. The safe connector according to claim 14, wherein only when said specific conducting element detects that said corresponding connector is connected with said safe conductor, said safe connector conducts electricity.

16. A safe connector comprising:

a casing having an opening;

a plurality of conducting elements set in said casing for conducting electricity;

a protecting board set in said casing for protecting said conducting elements from being touched, and having a plurality of holes set thereon, each of which corresponds to one of said conducting elements for passing said conducting elements therethrough;

a plurality of elastic bodies set around said plurality of conducting elements for urging said protecting board toward said opening; and a locking device having a plurality of locking pieces set around said protecting board in said casing for locking said protecting board in said casing, wherein said locking device includes a guard for preventing said protecting board from being pushed out of said opening and being pushed into said casing.

17. The safe connector according to claim 16, wherein said locking device is detachably set in said casing.

18. The safe connector according to claim 16, wherein said locking pieces have a guard for easily extending when said safe connector is connected with a corresponding connector and further have a holder for holding said protecting board thereon when disconnected from said corresponding connector.

19. The safe connector according to claim 16, wherein said conducting elements penetrate through said elastic bodies, holes set on said locking device, and holes set on said protecting board when said safe connector is connected to a corresponding connector.

20. The safe connector according to claim 16, wherein said locking device has a plurality of holes set thereon, each hole corresponding to one of said conducting elements for passing therethrough when said safe connector is connected to a corresponding connector.

21. The safe connector according to claim 16, wherein said guard is a V-shape guard.

22. The safe connector according to claim 21, wherein each of said locking pieces further includes a holder for holding said protecting board thereon.

23. A safe connector assembly comprising:

a female connector; and a male connector, said male connector including:

a casing defining an opening for receiving the female connector;

a plurality of conducting elements mounted in said casing and extending toward said opening;

a protecting board movably mounted in said casing and defining a plurality of holes, each hole being aligned with a corresponding one of said conducting elements; and a locking device mounted in said casing, wherein when said female connector is separated from said male connector, said locking device is biased against said protecting board to prevent movement of said protecting board into said casing, thereby preventing exposure of said plurality of conducting elements through the plurality of holes, and wherein when said female connector is coupled to said male connector, said locking member is biased away from said protecting board to allow movement of said protecting member into said casing, thereby causing said plurality of conducting elements to extend through the plurality of holes.

24. The safe connector assembly according to claim 23, further comprising an elastic member mounted in the housing for biasing the protecting board toward the opening.

* * * * *